US008882387B2

(12) United States Patent
Takano et al.

(10) Patent No.: US 8,882,387 B2
(45) Date of Patent: Nov. 11, 2014

(54) AIR-BLOWING-TYPE ROAD SURFACE SNOW-MELTING SYSTEM

(75) Inventors: Yoshiaki Takano, Sapporo (JP); Katsuyuki Ouchi, Sapporo (JP); Kazuhiko Tomita, Sapporo (JP); Shigeki Hirano, Sapporo (JP)

(73) Assignee: Hokusui Sekkei Consul Co., Ltd., Hokkaido (JP)

( * ) Notice: Subject to any disclaimer, the term of this patent is extended or adjusted under 35 U.S.C. 154(b) by 0 days.

(21) Appl. No.: 13/698,237

(22) PCT Filed: May 16, 2011

(86) PCT No.: PCT/JP2011/061191

§ 371 (c)(1),
(2), (4) Date: Nov. 15, 2012

(87) PCT Pub. No.: WO2011/145558

PCT Pub. Date: Nov. 24, 2011

(65) Prior Publication Data

US 2013/0058716 A1 Mar. 7, 2013

(30) Foreign Application Priority Data

May 18, 2010 (JP) ..... 2010-114691

(51) Int. Cl.
*E01C 23/14* (2006.01)
*E01C 7/00* (2006.01)
*E01C 11/26* (2006.01)

(52) U.S. Cl.
CPC ..... *E01C 11/26* (2013.01)
USPC ..... 404/95; 404/71

(58) Field of Classification Search
USPC ..... 404/95, 71; 405/131, 234; 219/213; 37/199, 227
See application file for complete search history.

(56) References Cited

U.S. PATENT DOCUMENTS 2,779,856 A * 1/1957 Fahner ..... 392/382
3,270,741 A * 9/1966 Petlak ..... 126/343.5 R (Continued)

FOREIGN PATENT DOCUMENTS

JP 2008-255774 A 10/2008
JP 4177423 B 11/2008

OTHER PUBLICATIONS

"Study of Snow-Melting System Using Permeable Blocks by Warm Air" of Dec. 1, 2006 by Fujieda Otake, et al. at 22nd Cold Region Technology Conference in Japan, vol. 22, p. 248-253.

*Primary Examiner* — Abigail A Risic
(74) *Attorney, Agent, or Firm* — DLA Piper LLP (US)

(57) ABSTRACT

Provided is an air-blowing-type road surface snow-melting system which makes it possible to reduce the height of a hollow roadbed body while also making the amount of air blown out from an air-permeable structure substantially uniform. An air-blowing-type road surface snow-melting system (1) comprises: a hollow roadbed body (2) which is provided with a hollow section (21) and is buried beneath a road surface; an air-permeable structure (3) which is disposed on the hollow roadbed body (2) to form the road surface; and a vent pipe (4) which is laid inside the hollow section (21) of the hollow roadbed body (2), wherein the vent pipe (4) is laid in the shape of a loop so as to enclose a predetermined snow-melting area and in addition a plurality of blow-out sections (42) which open toward the inside of the loop are disposed in the vent pipe (4).

5 Claims, 22 Drawing Sheets

(56) References Cited

U.S. PATENT DOCUMENTS

| | | | | | |
|---|---|---|---|---|---|
| 3,373,734 | A * | 3/1968 | Roemer | 126/343.5 R |
| 3,410,977 | A * | 11/1968 | Ando | 219/618 |
| 3,791,443 | A * | 2/1974 | Burt et al. | 165/45 |
| 5,178,485 | A * | 1/1993 | Katsuragi et al. | 404/95 |
| 5,213,445 | A * | 5/1993 | Ikenberry et al. | 405/128.9 |
| 5,368,092 | A * | 11/1994 | Rearden et al. | 165/45 |
| 5,605,418 | A * | 2/1997 | Watanabe et al. | 405/131 |
| 5,820,301 | A * | 10/1998 | Bruckelmyer | 405/229 |
| 5,986,237 | A * | 11/1999 | Sterling et al. | 219/213 |
| 6,959,145 | B1 * | 10/2005 | Narvaez | 392/382 |
| 8,550,744 | B1 * | 10/2013 | Lee | 404/71 |
| 2004/0016740 | A1 * | 1/2004 | McDonald | 219/213 |
| 2005/0254802 | A1 * | 11/2005 | Shields | 392/379 |
| 2006/0272631 | A1 * | 12/2006 | Coke et al. | 126/271.2 A |

* cited by examiner

| | A | | B | | C | |
|---|---|---|---|---|---|---|
| | L | R | L | R | L | R |
| 3R | 1 | 3 | 5 | 7 | 9 | 11 |
| 3F | 2 | 4 | 6 | 8 | 10 | 12 |
| 2R | 24 | 22 | 20 | 18 | 16 | 14 |
| 2F | 23 | 21 | 19 | 17 | 15 | 13 |

m/s

| | A | | B | | C | |
|---|---|---|---|---|---|---|
| | L | R | L | R | L | R |
| 3R | 0.75 | 0.41 | 0.46 | 0.52 | 0.63 | 0.66 |
| 3F | 0.85 | 0.49 | 0.52 | 0.57 | 0.45 | 0.56 |
| 2R | 0.54 | 0.43 | 0.53 | 0.52 | 0.41 | 0.85 |
| 2F | 0.67 | 0.64 | 0.53 | 0.40 | 0.42 | 0.86 |

m/s

| | A | | B | | C | |
|---|---|---|---|---|---|---|
| | L | R | L | R | L | R |
| 3R | 1.03 | 0.47 | 0.40 | 0.40 | 0.65 | 0.77 |
| 3F | 1.09 | 0.61 | 0.43 | 0.42 | 0.42 | 0.67 |
| 2R | 0.64 | 0.38 | 0.42 | 0.45 | 0.38 | 1.22 |
| 2F | 0.70 | 0.61 | 0.43 | 0.35 | 0.47 | 1.16 |

(a) $\phi$ 4mm (b) $\phi$ 6mm (c) $\phi$ 8mm (d) $\phi$ 10mm

AIR-BLOWING-TYPE ROAD SURFACE SNOW-MELTING SYSTEM

TECHNICAL FIELD

The present invention relates to an air-blowing-type road surface snow-melting system for melting snow on a road surface by bringing air into direct contact with the snow.

BACKGROUND ART

Attempts have been made to melt snow falling around a house and on a road surface with air as a heating medium. In particular, the inventors are continuously researching and developing technology for blowing air from a road surface and bringing the air into direct contact with snow fallen on a road surface or falling snow to melt the snow.

For example, Japanese Patent No. 4177423 proposes an air-blowing snow melting/drying system including a hollow roadbed body provided with a hollow section which is buried beneath a road surface and has a hole that lets air circulate through the hollow section and allows snowmelt water from the road surface to fall into the hollow section, an air-permeable structure provided on the hollow roadbed body to constitute the road surface, and air injection means for injecting air at 0° C. or higher into the hollow section of the hollow roadbed body, and the system is patented (Patent Literature 1). According to Patent Literature 1, the air-blowing snow melting/drying system can bring air blown from a road surface into direct contact with snow and evenly and uniformly melt snow on the road surface by the heat-retaining effect of the air-permeable structure brought about by passage of the air.

CITATION LIST

Patent Literature

Patent Literature 1: Japanese Patent No. 4177423

SUMMARY OF INVENTION

Technical Problem

Note that, regarding the invention described in Patent Literature 1, there is a strong desire to reduce the burden of the work of digging beneath the road surface during construction and save construction cost and material cost by reducing the height of the hollow roadbed body buried beneath a road surface.

However, a reduction in the height of the hollow roadbed body makes the inside of the hollow section smaller and makes circulation of air likely to be blocked. This produces a difference in the amount of air supplied between a position near an air supply port to which air is supplied and one distant from the air supply port. The difference in the amount of air in the hollow section makes the amount of air blown from the air-permeable structure non-uniform and causes snow-melting unevenness. Thus, there is a need for technological improvement that makes the amount of air blown from the air-permeable structure uniform even if the height of the hollow roadbed body is small.

The present invention has been made in order to meet such demands and has as its object to provide an air-blowing-type road surface snow-melting system capable of reducing the height of a hollow roadbed body while making the amount of air blown from an air-permeable structure substantially uniform.

Solution to Problem

An air-blowing-type road surface snow-melting system according to the present invention is an air-blowing-type road surface snow-melting system including a hollow roadbed body which is buried beneath a road surface and including a hollow section, an air-permeable structure provided on the hollow roadbed body and constituting the road surface, and a vent pipe which is laid inside the hollow section of the hollow roadbed body, wherein the vent pipe is laid in the shape of a loop so as to enclose a predetermined snow-melting area and is provided with a plurality of blow-out sections which open toward the inside of the loop.

As an aspect of the present invention, the plurality of blow-out sections may be arranged such that the blow-out sections at opposing positions are staggered in a looped frame.

As an aspect of the present invention, a plurality of exhaust holes may be opened in the vent pipe in a loop outer side surface along the vent pipe.

As an aspect of the present invention, a position where an air supply pipe which supplies air to the looped vent pipe may be coupled is spaced apart by a predetermined distance from the blow-out sections and may be substantially equidistant from two of the blow-out sections which are arranged on the left and right sides of the air supply pipe.

Advantageous Effect of Invention

According to the present invention, it is possible to reduce the height of a hollow roadbed body while ensuring that the amount of air blown from an air-permeable structure is substantially uniform.

DESCRIPTION OF EMBODIMENTS

Figure 1:
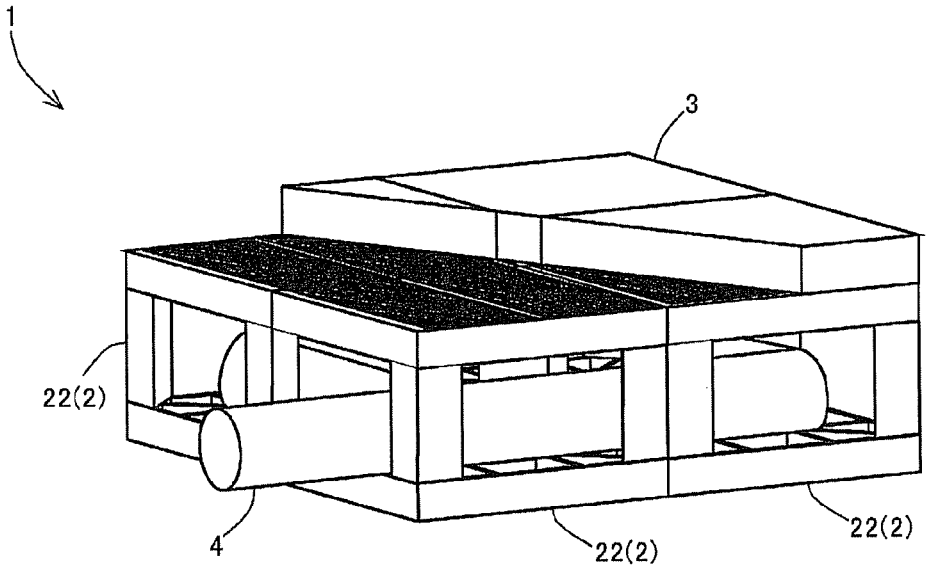
FIG. 1 is a perspective view showing an embodiment of an air-blowing-type road surface snow-melting system according to the present invention.

An embodiment of an air-blowing-type road surface snow-melting system according to the present invention will be described below using drawings. FIG. 1 is a perspective view showing the configuration of an air-blowing-type road surface snow-melting system according to this embodiment.

As shown in FIG. 1, an air-blowing-type road surface snow-melting system 1 according to this embodiment is mainly composed of a hollow roadbed body 2, an air-permeable structure 3, and a vent pipe 4.

Components of the air-blowing-type road surface snow-melting system 1 according to this embodiment will be described below in detail.

The hollow roadbed body 2 includes a hollow section 21 and is buried in a dug recess beneath a road surface. The hollow roadbed body 2 according to this embodiment is composed of a plurality of box-like roadbed bodies 22 which are formed in the shape of a box. The hollow roadbed body 2 is constructed by laying the box-like roadbed bodies 22 in an arbitrary manner.

Figure 2:
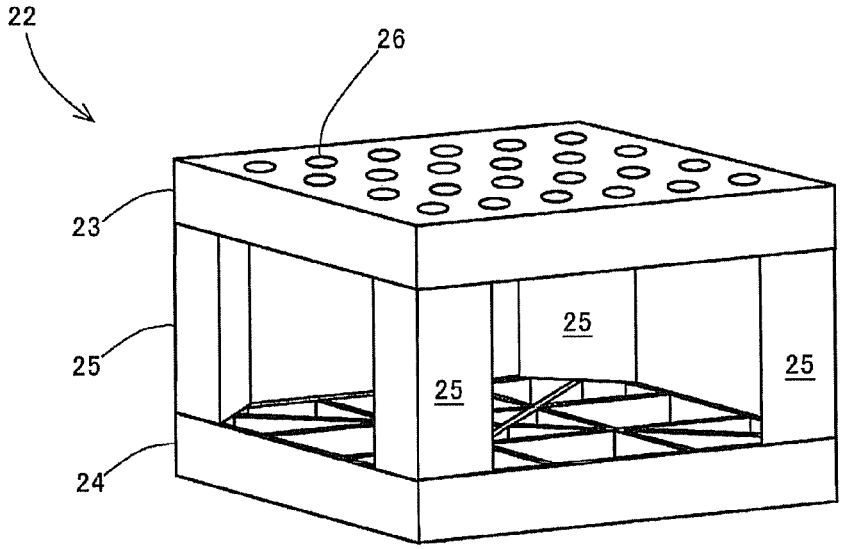
FIG. 2 is a perspective view showing a box-like roadbed body constituting a hollow roadbed body according to this embodiment.

The box-like roadbed body 22 according to this embodiment is made of, e.g., synthetic chemical resin, such as polypropylene, or reinforcing steel. As shown in FIG. 2, the box-like roadbed body 22 is composed of a top plate 23 and a base plate 24 which are of substantially rectangular shape and supports 25 which support the top plate 23 and base plate 24 at four corners. The box-like roadbed body 22 has the hollow section 21 in the center.

The top plate 23 according to this embodiment includes a circulation hole 26 for letting air supplied to the hollow section 21 flow to the air-permeable structure 3 and letting water melted from snow by the air on a road surface, rainwater, or the like flow into the hollow section 21. Note that although the number and size of circulation holes 26 are arbitrarily selected, the circulation holes 26 are preferably formed to have as large an opening area as possible as long as the top plate 23 ensures strength enough for a road surface, in order not to block passage of air and water.

The base plate 24 according to this embodiment is configured to be capable of storing water and can retain snowmelt water or rainwater flowing down through the circulation holes 26 in the top plate 23.

The support 25 according to this embodiment is configured to be capable of being replaced, and the height of the box-like roadbed body 22 can be adjusted by changing the leg length of the support 25.

The hollow section 21 according to this embodiment is formed between the top plate 23 and the base plate 24 of each box-like roadbed body 22 by the top plate 23, base plate 24, and supports 25. Adjacent ones of the box-like roadbed bodies 22 allow passage of air therebetween through the hollow sections 21.

Figure 3:
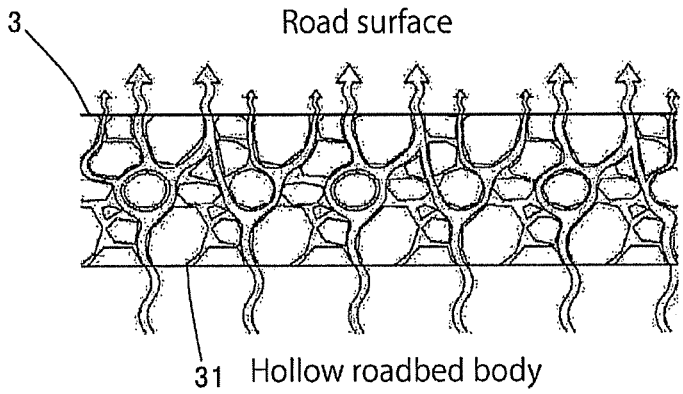
FIG. 3 is a vertical cross-sectional view showing a branched void network of an air-permeable structure according to this embodiment and flows of air passing through the branched void network.

The air-permeable structure 3 is provided on the hollow roadbed body 2 and constitutes a road surface. The air-permeable structure 3 has many holes for allowing communication between the circulation holes 26 in the hollow roadbed body 2 and space on a road. As shown in FIG. 3, the air-permeable structure 3 according to this embodiment includes, in its inside, a branched void network 31 which meanders, branches off repeatedly, and is continuous. For example, porous concrete that is obtained by adhesively securing gravel, crushed stone, construction and demolition waste, and the like with concrete can be adopted as the material.

Note that the air-permeable structure 3 is not limited to one made of the porous concrete and that various materials, such as a rubber piece or a polypropylene piece, may be secured with, e.g., adhesive to form the branched void network 31. Alternatively, grass whose roots get entangled to form the branched void network 31 may be used, if the strength is enough.

Figure 4:
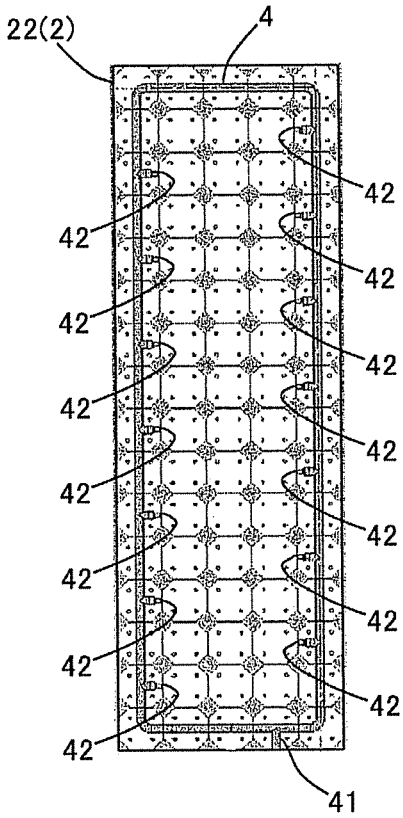
FIG. 4 is a plan view showing a vent pipe laid in the hollow roadbed body according to this embodiment.

The vent pipe 4 is composed of a tubular member of synthetic chemical resin, such as vinyl chloride, or metal. As shown in FIG. 4, the vent pipe 4 is laid in the shape of a loop so as to enclose a predetermined snow-melting area inside the hollow roadbed body 2. In this embodiment, the vent pipe 4 extends through the supports 25 of the box-like roadbed bodies 22 within the snow-melting area to constitute a loop frame of substantially rectangular shape. An air supply pipe 41 which supplies air is coupled to one short side of the looped vent pipe 4.

Figure 5:
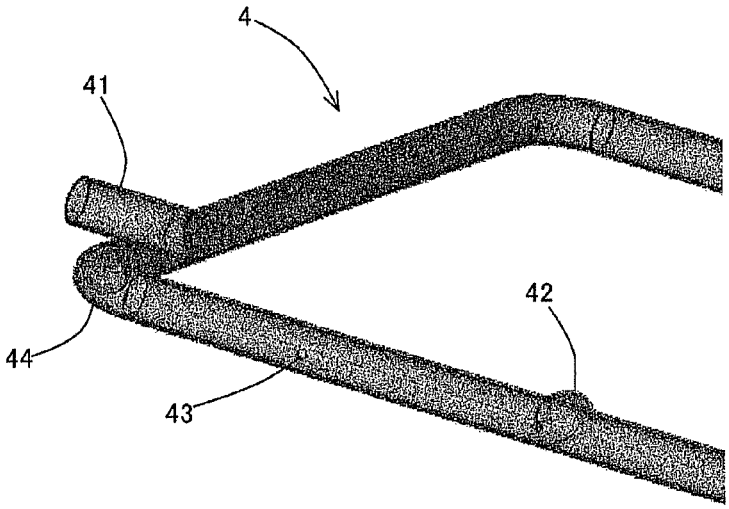
FIG. 5 is an enlarged perspective view showing the vent pipe according to this embodiment.

A plurality of blow-out sections 42 which open toward the inside of the loop are provided at the vent pipe 4. As shown in FIG. 5, a plurality of exhaust holes 43 are formed in a loop outer side surface of the vent pipe 4, and the circulation holes 26 immediately above the exhaust holes 43 can blow out air using air discharged through the exhaust holes 43. Note that the vent pipe 4 according to this embodiment has a downward slope toward an arbitrary one of four corners and that a drainage hole 44 for drainage is provided at the bottom of the corner.

The blow-out section 42 according to this embodiment is composed of a tubular member of synthetic chemical resin or metal, like the vent pipe 4. The blow-out sections 42 are arranged inside every other box-like roadbed body 22 along long sides at opposing positions of the looped vent pipe 4 in a staggered manner. Distal ends of the blow-out sections 42 open toward the inside of the loop.

Note that the size of an opening at the distal end of each blow-out section 42 is not particularly limited and is appropriately designed according to the amount of air to be supplied, the shape of the vent pipe 4, the shape of the hollow roadbed body 2, and the like such that air is supplied to the whole area inside the loop.

The exhaust hole 43 according to this embodiment is intended to supply air to an area to which enough air is not supplied from the blow-out sections 42. The exhaust hole 43 is formed so as to be smaller than the opening of the blow-out section 42 and opens at the loop outer side surface of the vent pipe 4 along the vent pipe 4 for each box-like roadbed body 22.

The air supply pipe 41 according to this embodiment is coupled to air supply means (not shown) including a blower fan and is coupled to a predetermined position of the vent pipe 4. The air supply pipe 41 is configured to supply a required amount of air into the vent pipe 4. The position where the air supply pipe 41 is coupled is set at a position which is spaced apart by a predetermined distance from the blow-out sections 42 such that a blowing speed at the closest blow-out section 42 and a blowing speed at a different one of the blow-out sections 42 are substantially equal. The position is preferably set at a position which is substantially equidistant from two of the blow-out sections 42 which are provided on the left and right sides of the air supply pipe 41 along the vent pipe 4. This is because the blowing speeds can be easily adjusted so as to be equal to each other.

Although the air supply means coupled to the air supply pipe 41 is not shown, the air supply means can supply air as a heating medium to the vent pipe 4 and includes a blower fan which can control the amount of air by inverter control in this embodiment.

Action of each component in the air-blowing-type road surface snow-melting system 1 according to this embodiment will be described.

Air supplied by the air supply means to melt snow on a road surface includes air warmed by, e.g., a boiler, air discharged from a building such as a house or a subway or the like through ventilation, air in a sewer, air warmed by geothermal heat, and air warmed by hot spring heat which have a temperature of 0° C. or higher. Accordingly, the air supply means supplies air having a temperature of 0° C. or higher to the vent pipe 4 via the air supply pipe 41 with the blower fan.

The air supplied to the vent pipe 4 circulates through the vent pipe 4 along the loop. When the internal pressure increases, the air is blown from the blow-out sections 42 and through the exhaust holes 43 and is supplied into the hollow sections 21. Note that since the exhaust hole 43 is formed so as to be smaller than the opening of the blow-out section 42, the air is blown into the hollow sections 21 mainly from the blow-out sections 42.

Since the vent pipe 4 formed in the shape of a loop makes the internal pressure of the vent pipe 4 uniform in this embodiment, the blow-out sections have the same air pressure. Additionally, the air supply pipe 41 is provided at a position as equidistant from the two blow-out sections 42 on the left and right sides of the air supply pipe 41 as possible, and air is inhibited from being disproportionately blown to either one side of the blow-out section 42. Accordingly, air is blown at substantially equal speeds from the blow-out sections 42 according to this embodiment toward the inside of the loop.

In this embodiment, the blow-out sections 42 are arranged inside every other box-like roadbed body 22 at opposing positions in a staggered manner. Thus, jets of air from the blow-out sections 42 do not coincide with each other.

Air blown from the blow-out section 42 passes through the hollow sections 21 of the box-like roadbed bodies 22 in a blowing direction and reaches the hollow section 21 of the box-like roadbed body 22, through which the vent pipe 4 runs.

Note that circulation of air blown from the blow-out section 42 may be blocked by the vent pipe 4, which is at an opposing position thereto, and that enough air may not be supplied to outside the loop. If the height of the box-like roadbed body 22 is low, ventilation space is narrow, and enough air may not reach the adjacent hollow section 21.

For this reason, in this embodiment, the exhaust hole 43 is formed along the outer side surface of the vent pipe 4 for each box-like roadbed body 22. The exhaust hole 43 discharges air into the hollow section 21 of each box-like roadbed body 22, thereby supplementing the amount of air at a location where supply is likely to be insufficient. Since air discharged through the exhaust holes 43 is adjusted in the same manner as in the blow-out sections 42 by the looped vent pipe 4 such that the pressure inside the vent pipe 4 is as uniform as possible, air is discharged at substantially equal speeds through the exhaust holes 43 toward the outside of the loop.

Accordingly, among the hollow sections 21 according to this embodiment, air supplied from the blow-out sections 42 and through the exhaust holes 43 is distributed with minimum unevenness.

Air supplied from the blow-out sections 42 and through the exhaust holes 43 to each box-like roadbed body 22 passes through the circulation holes 26 in the top plate 23 and is fed to the air-permeable structure 3. Note that the circulation hole 26 according to this embodiment is large and does not block circulation.

The air fed to the air-permeable structure 3 passes through the branched void network 31 while branching off repeatedly until it reaches the road surface and is blown onto the road surface, as shown in FIG. 3. Since air in the hollow sections 21 is substantially uniformly distributed at this time, air is blown from the air-permeable structure 3 onto the road surface with little unevenness.

The air blown onto the road surface comes into direct contact with snow fallen on the road surface or falling snow and melts the snow. Additionally, warm air flows slowly through the branched void network 31 to warm the air-permeable structure 3, and the heat from this warming also melts snow. This enhances the snow-melting effect.

According to this embodiment, air is blown from the air-permeable structure 3 with reduced unevenness, and occurrence of uneven snow melting on the road surface can be inhibited.

Snowmelt water on the road surface enters the branched void network 31 of the air-permeable structure 3. The snowmelt water is dried in the branched void network 31 or, if the amount of water is large, passes through the branched void network 31 and flows into the hollow sections 21 of the hollow roadbed body 2. The snowmelt water flowing into each hollow section 21 is stored in the base plate 24. A puddle from snowmelt water is thus unlikely to be formed on the road surface. When snowmelt water passes through the branched void network 31, dirt or the like may be discharged together. After snow on the road surface melts, since the road surface can be dried by supplying air to the air-permeable structure 3, the road surface can be prevented from freezing.

In the branched void network 31 of the air-permeable structure 3, even if some channels are occupied with, e.g., penetration of snowmelt water, the other channels are unoccupied. It is thus possible to blow air onto the road surface while letting snowmelt water flow through the branched void network 31, and circulation of air is unlikely to stop completely.

Note that if the humidity of air supplied to the hollow roadbed body 2 is high, dew condensation may occur inside the vent pipe 4 due to the difference in temperature between the air and the vent pipe 4. If dew condensation water accumulates in the vent pipe 4, the blow-out section 42 or the exhaust hole 43 may be plugged with the water. For this reason, in this embodiment, dew condensation water is made to flow along the sloped vent pipe 4 to the corner and is discharged through the drainage hole 44.

Note that since the hollow roadbed body 2 according to this embodiment is composed of the plurality of box-like roadbed bodies 22, even if the hollow roadbed body 2 is broken, the hollow roadbed body 2 can be replaced one box-like roadbed body 22 at a time. Management and maintenance of the hollow roadbed body 2 is thus easy.

Also, the air-blowing-type road surface snow-melting system 1 is effective in coping with the heat-island phenomenon. More specifically, the air-blowing-type road surface snow-melting system 1 can prevent or inhibit the heat-island phenomenon by blowing air colder than the temperature of the road surface onto the road surface. Additionally, rainwater stored in the base plate 24 evaporates to produce the same effects as those of sprinkling, which achieves inhibition of the heat-island phenomenon.

The air-blowing-type road surface snow-melting system 1 according to this embodiment includes the hollow sections 21 with appropriate space for the hollow roadbed body 2. With the air-blowing-type road surface snow-melting system 1, it is also possible to let water penetrate through the air-permeable structure 3 and use the hollow roadbed body 2 as a reservoir in the case of, e.g., a flood or a localized torrential downpour and to cope with an urban flood disaster, such as a sudden downpour.

The above-described air-blowing-type road surface snow-melting system 1 according to this embodiment can achieve the following advantages.

1. Even if the height of the hollow roadbed body 2 is configured to be low, unevenness in air supplied into the hollow sections 21 can be inhibited.
2. Since unevenness in air blown from the air-permeable structure 3 is inhibited, occurrence of uneven snow melting on a road surface can be inhibited.
3. Air is brought into direct contact with snow, which allows efficient snow melting.
4. The air-blowing-type road surface snow-melting system 1 serves as a countermeasure against the heat-island phenomenon and a countermeasure against floods and localized torrential downpours.

Example 1

In Example 1, a test body of an air-blowing-type road surface snow-melting system 1 which was composed of a hollow roadbed body 2 and a vent pipe 4 was fabricated, and an experiment for checking how the speed and the like of air blown from the hollow roadbed body 2 behave when air is fed into the test body was performed. In addition, a thermal fluid analysis simulation was performed under the same conditions as those for the test body, using thermal fluid analysis software.

Configuration of Experiment System in Example 1

Figure 6:
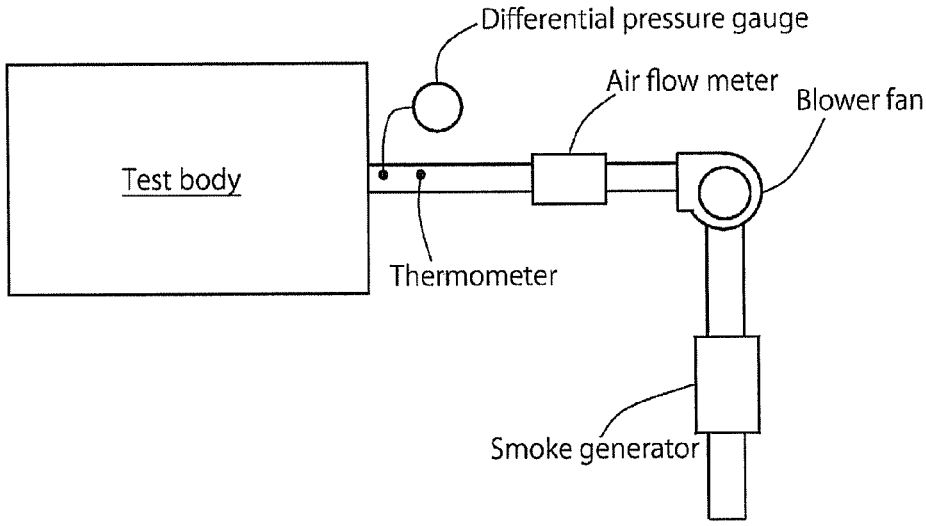
FIG. 6 is a block diagram showing an experiment system according to Example 1.

FIG. 6 is a block diagram showing an experiment system according to this Example 1. As shown in FIG. 6, the experiment system according to this Example 1 includes the test body, a blower fan for feeding air to the test body, and a smoke generator for visualization. An air flow meter, a differential pressure gauge, and a thermometer are also provided between the test body and the blower fan.

Figure 7:
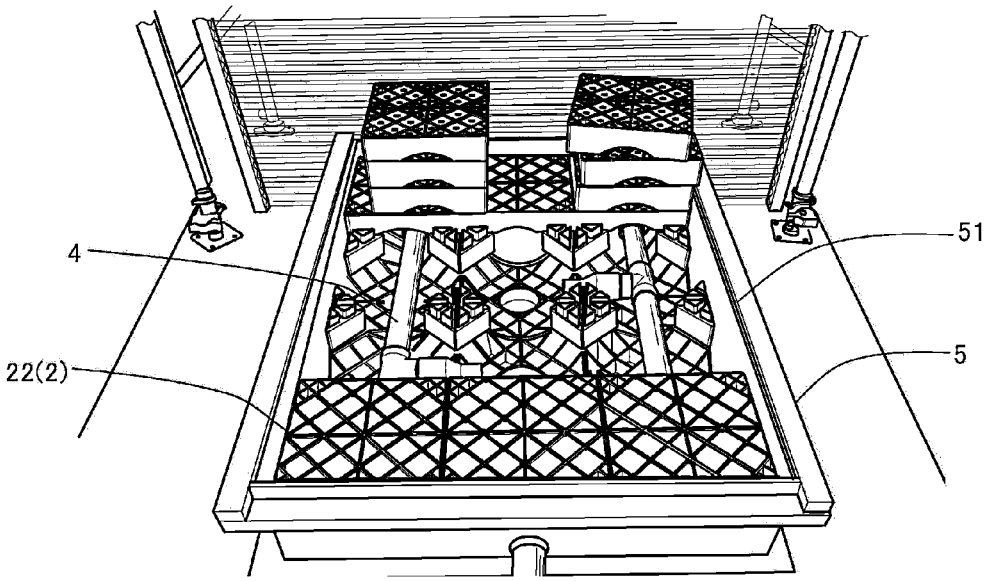
FIG. 7 is a digital photographic image obtained by shooting a test body used in this Example 1.

As shown in FIG. 7, the test body used in this Example 1 is composed of the hollow roadbed body 2, the vent pipe 4, and a frame 5 enclosing the hollow roadbed body 2.

Figure 8:
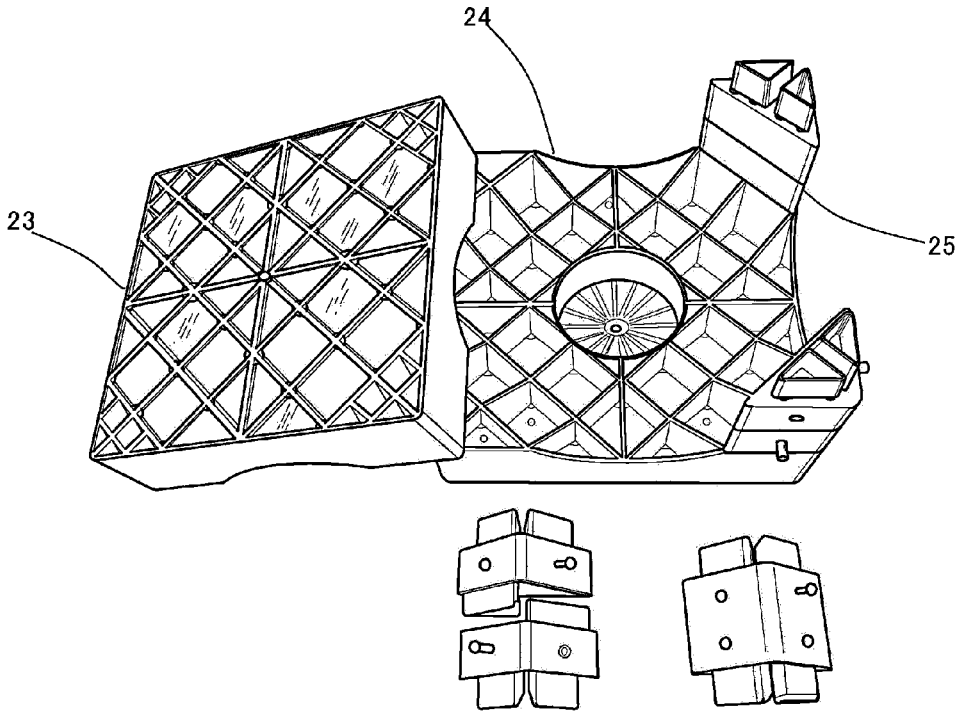
FIG. 8 is a digital photographic image obtained by shooting a box-like roadbed body constituting a hollow roadbed body used in this Example 1.

The hollow roadbed body 2 according to this Example 1 was constructed by laying 12 box-like roadbed bodies 22 while arranging the box-like roadbed bodies 22 in 4 rows and 3 columns within the frame 5. As shown in FIG. 8, the box-like roadbed body according to this Example 1 is made of synthetic chemical resin, and a top plate 23 and a base plate 24 are formed in the shape of a square 300 mm on a side so as to have a height of 75 mm. Supports 25 are replaceably coupled to four corners of the top plate 23 and four corners of the base plate 24. In experiments in this Example 1, the supports 25 of two types, the supports 25 having a leg length of 25 mm and a leg length of 75 mm were used.

Note that row numbers 1 to 4 were assigned to the rows of the box-like roadbed bodies 22 while column symbols A to C were assigned to the columns. The top plates 23 of the box-like roadbed bodies 22 in rows 2 and 3 were perforated with a total of 96 circulation holes 26. The diameter of the circulation holes 26 is 13 mm.

The frame 5 according to this Example 1 was formed of plywood. A cushioning material 51 was provided on an inner surface of the frame 5 so as to avoid leakage of air.

Figure 10:
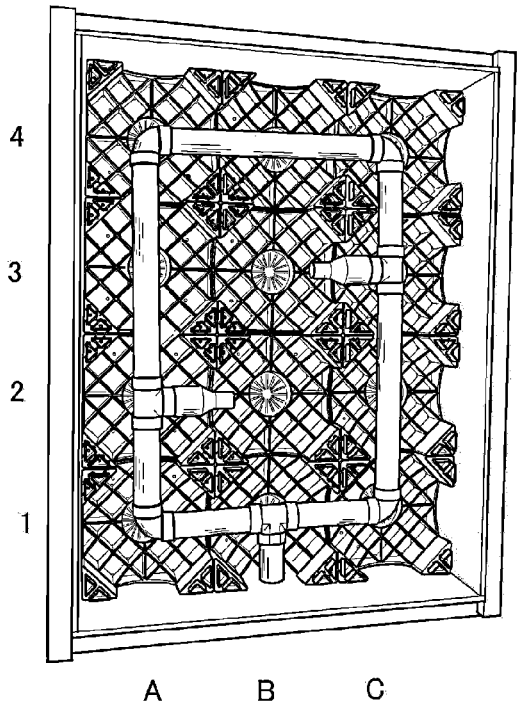
FIG. 10 is a digital photographic image obtained by shooting a vent pipe laid inside the hollow roadbed body used in this Example 1.

As shown in FIG. 10, the vent pipe 4 according to this Example 1 is formed of a circular tube having an inner diameter of 50 mm and made of vinyl chloride, is formed in the shape of a substantially rectangular loop frame 600 mm on the short side and 900 mm on the long side, and is laid so as to extend through hollow sections 21.

Blow-out sections 42 according to this Example 1 were provided one-by-one in a staggered manner, on the long side portion of the vent pipe 4. More specifically, the blow-out sections 42 were arranged inside the hollow sections 21 of the box-like roadbed bodies 22 in "row 2 and column A" and "row 3 and column C." Note that the diameter of an opening of the blow-out section 42 is 25 mm.

Figure 9:
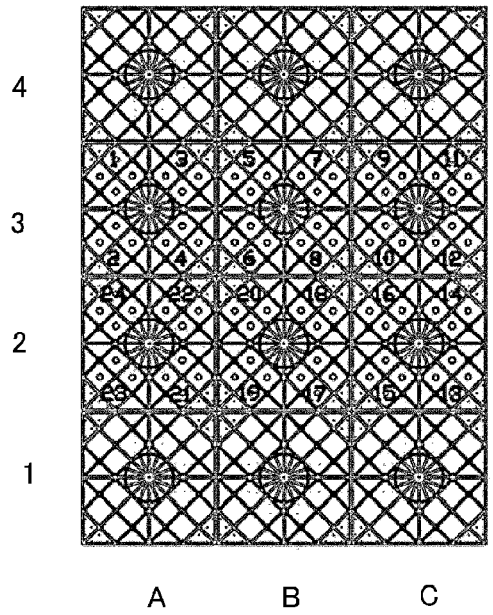
FIG. 9 is a plan view of the hollow roadbed body showing grouped circulation holes and numbers corresponding to the circulation holes in this Example 1.
Figures 11, 12:
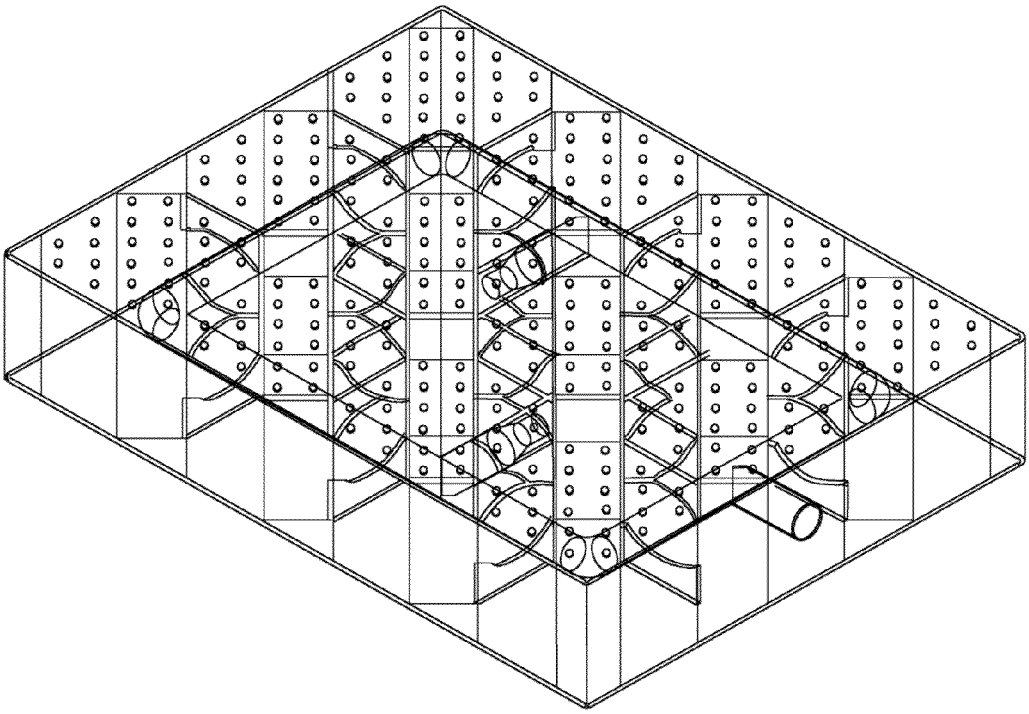
FIG. 11 is a table showing the correspondence between row numbers and column symbols assigned to box-like roadbed bodies and measurement position numbers assigned to circulation holes in this Example 1.
FIG. 12 is a perspective view showing an analysis model which is created in substantially the same shape as the test body used in an experiment in this Example 1.

Note that in this Example 1, hot-wire anemometers were arranged at 24 circulation holes 26 of the 96 circulation holes 26 formed in the hollow roadbed body 2 to measure speeds of blowing air, and measurement position numbers 1 to 24 were assigned to the positions, respectively, of the hot-wire anemometers, as shown in FIG. 9. A table of correspondence between the row numbers and column symbols assigned to the box-like roadbed bodies 22 and the measurement position numbers is shown in FIG. 11.

In this Example 1, commercially available SolidWorks and COSMOSFloWorks were used as thermal fluid analysis software. FIG. 12 is an analysis model for simulating the test body in the experiment system according to this Example 1.

Experiment Result and Simulation Result when Leg Length of Hollow Roadbed Body was 75 Mm First, a result of an experiment when the leg length of the support 25 of the hollow roadbed body 2 was 75 mm, and the total height of the hollow roadbed body 2 including the top plate 23 and base plate 24 was 225 mm will be described. Note that during the test, the air supply rate was 24.9 to 25.8 $m^3$/h, the air supply temperature was 20.7 to 20.9° C., and the pressure loss was 14.5 to 15 Pa.

Figures 13, 14:
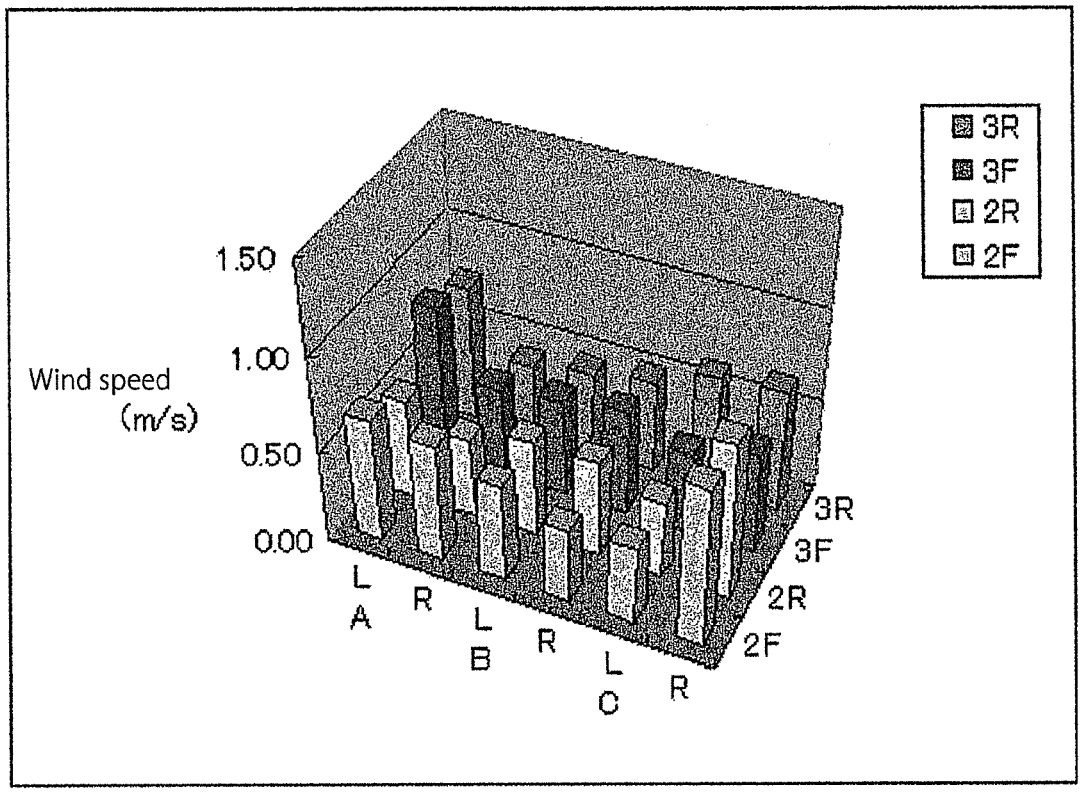
FIG. 13 is a table listing blowing speeds at the circulation holes measured at measurement positions 1 to 24 by a hot-wire anemometer when the height of the hollow roadbed body is 225 mm, in this Example 1.
FIG. 14 is a three-dimensional bar graph showing the blowing speeds at the circulation holes in FIG. 13 in this Example 1.
Figure 15:
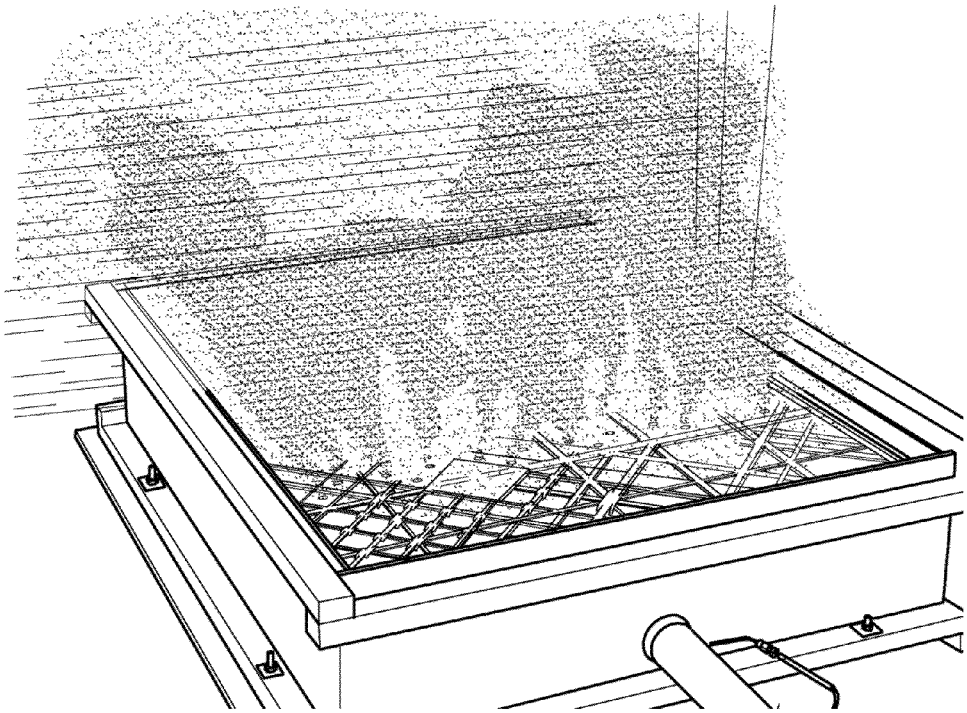
FIG. 15 is a digital photographic image showing a result of a visualization experiment using a smoke generator when the height of the hollow roadbed body is 225 mm, in this Example 1.

FIG. 13 is a table listing blowing speeds at the circulation holes 26 measured at measurement positions 1 to 24 by the hot-wire anemometers. FIG. 14 shows, as a three-dimensional bar graph, the blowing speeds at the circulation holes 26 shown in FIG. 13. FIG. 15 is an image showing a result of a visualization experiment by white smoke using the smoke generator.

As shown in FIGS. 13 and 14, the blowing speeds of air blown in "row 2 and column C" and "row 3 and column A" were higher than the blowing speeds at the other circulation holes 26. It can also be seen from FIG. 15 that the amounts of white smoke blown in "row 2 and column C" and "row 3 and column A" are large.

The higher blowing speeds in "row 2 and column C" and "row 3 and column A" are thought to be greatly affected by the blowing directions of the blow-out sections 42 of the vent pipe 4. That is, the blow-out section 42 is provided so as to extend from column A toward column C in row 2, and air blown from the blow-out section 42 is thought to collide with a wall on the rear side and be blown through the circulation holes 26 in column C.

Figures 16, 17:
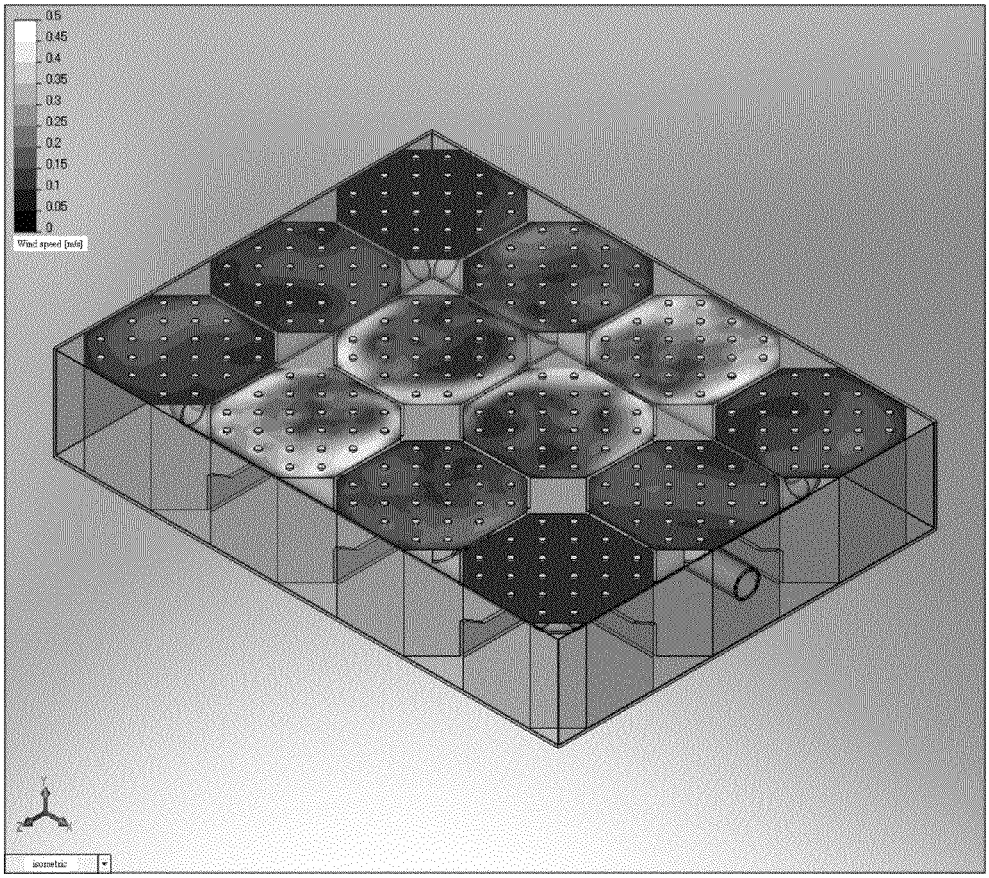
FIG. 16 is a simulation result showing a distribution of wind speed in the hollow section when the height of the hollow roadbed body is 225 mm, in this Example 1.
FIG. 17 is a table listing blowing speeds at the circulation holes measured at measurement positions 1 to 24 by the hot-wire anemometer when the height of the hollow roadbed body is 175 mm, in this Example 1.

FIG. 16 shows a distribution of wind speed in the hollow sections 21 which was analyzed by a thermal fluid analysis simulation. A whiter part has a higher wind speed, and a blacker part has a lower wind speed. Note that the result was obtained when the simulation was performed at an air supply rate of 25.2 $m^3$/h at an air supply temperature of 20° C.

It can be seen from FIG. 16 that wind speeds in "row 2 and column C" and "row 3 and column A" are higher in the distribution of speed in the hollow sections 21, like the experiment result shown in FIGS. 13 to 15. The distribution of wind speed and blowing speed are thought to be substantially in a proportional relationship.

Experiment Result and Simulation Result when Leg Length of Hollow Roadbed Body was 25 Mm An experiment was performed with the hollow roadbed body 2 having a reduced height, in which the leg length of the support 25 of the hollow roadbed body 2 was 25 mm, and the total height of the hollow roadbed body 2 including the top plate 23 and base plate 24 was 175 mm. During the test, the air supply rate was 24.9 to 25.8 $m^3$/h, the air supply temperature was 30.7° C., and the pressure loss was 15 to 15.25 Pa.

Figure 18:
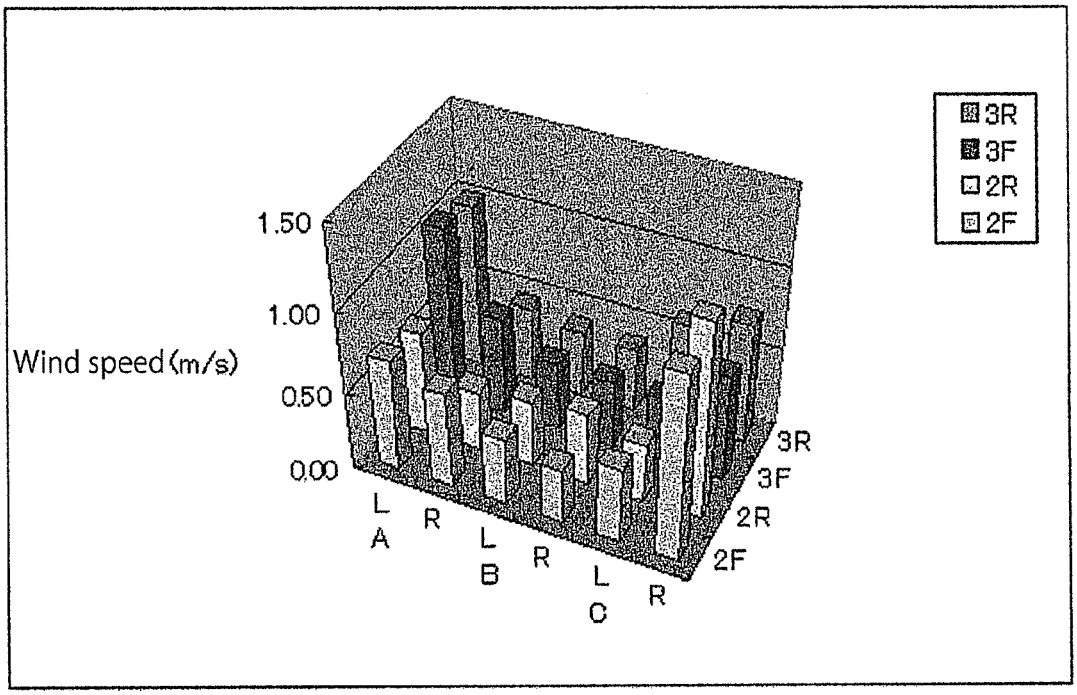
FIG. 18 is a three-dimensional bar graph showing the blowing speeds at the circulation holes in FIG. 17 in this Example 1.
Figure 19:
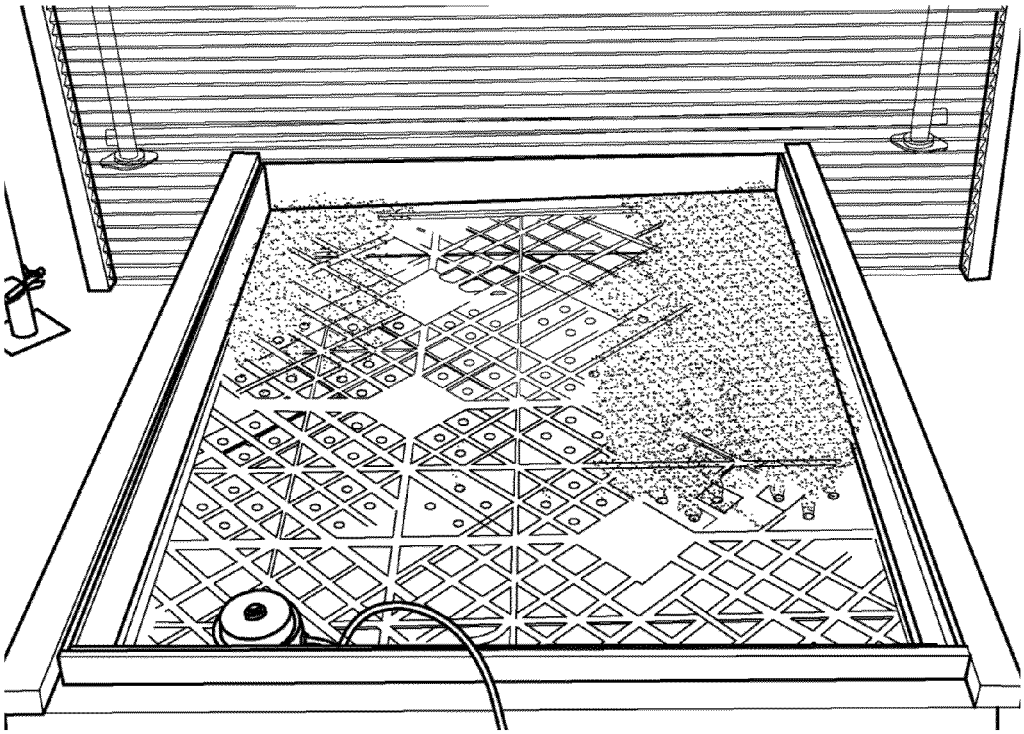
FIG. 19 is a digital photographic image showing a result of a visualization experiment using the smoke generator when the height of the hollow roadbed body is 175 mm, in this Example 1.
Figure 20:
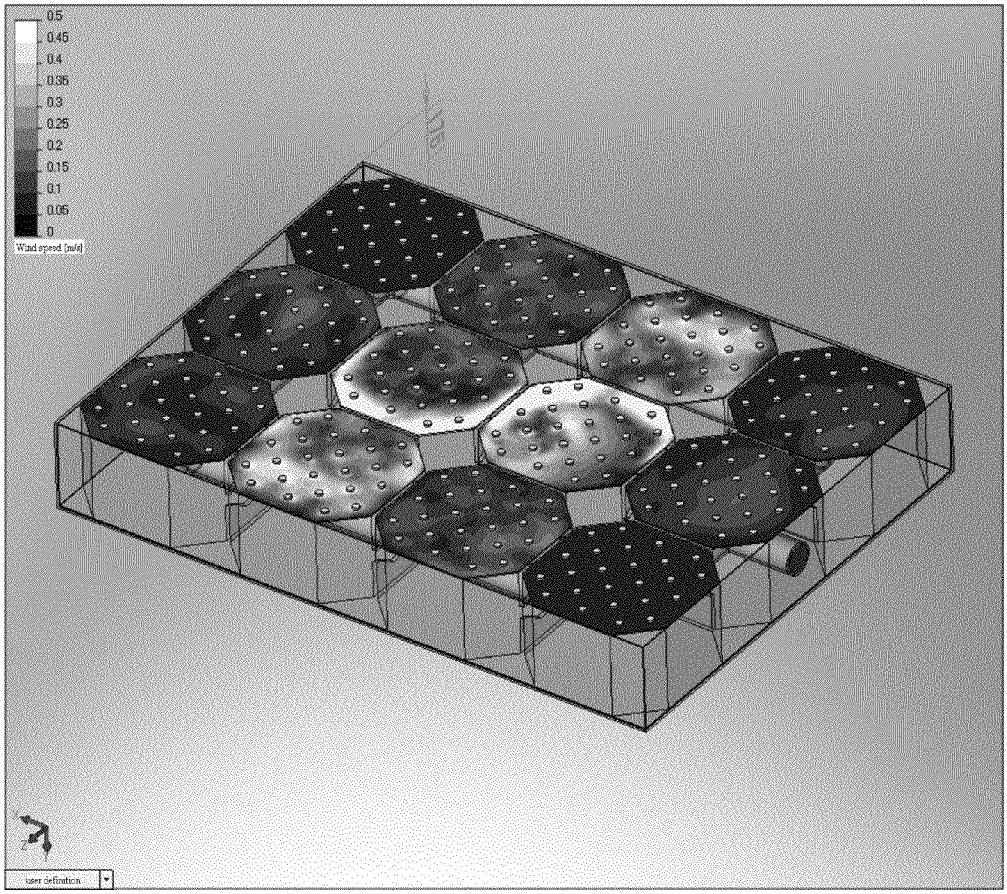
FIG. 20 is a simulation result showing a distribution of wind speed in the hollow section when the height of the hollow roadbed body is 175 mm, in this Example 1.

FIG. 17 is a table listing blowing speeds at the circulation holes at measurement positions 1 to 24. FIG. 18 is a three-dimensional bar graph of FIG. 17. FIG. 19 is an image showing a result of a visualization experiment, and FIG. 20 is a result of a simulation.

As shown in FIGS. 17 to 19, the blowing speeds in "row 2 and column C" and "row 3 and column A" were higher, as in the case where the leg length of the hollow roadbed body 2 was 75 mm. Note that the differences in blowing speed from the other circulation holes 26 were larger than those in the case where the leg length of the hollow roadbed body 2 was 75 mm.

The reason for the increase in the blowing speed differences is thought to be that the reduction in leg length narrowed each hollow section 21 and that the speed of air passing through the hollow section 21 increased to increase the ability of air to go straight. A comparison between the simulation results in FIGS. 16 and 20 shows that wind speeds in rows 1 and 4 not in the blowing directions of the blow-out sections 42 were lower in this experiment result with the hollow roadbed body 2 having the reduced height. From this, it can be seen that the ability of air to go straight increased.

As has been described above, it can be seen from the experiments and simulations in this Example 1 that a reduction in the height of the hollow roadbed body 2 increases non-uniformity in a distribution of wind speed in the hollow sections 21 and non-uniformity in blowing speed at the circulation holes 26.

In light of the results in Example 1, improvements to the hollow roadbed body 2 and vent pipe 4 for making a distribution of wind speed in the hollow sections 21 uniform were discussed in Examples 2 and 3 by simulating analysis models under various conditions.

Example 2

In Example 2, the size of a circulation hole 26 formed in a top plate 23 of a hollow roadbed body 2 was discussed. An analysis model in this Example 2 is the same as that used in the simulations in Example 1. Note that a total of 192 circulation holes 26 are formed across the hollow roadbed body 2. A simulation was performed for each of four cases (a) where a diameter ϕ of the circulation hole 26 was 4 mm, (b) where the diameter ϕ was 6 mm, (c) where the diameter ϕ was 8 mm, and (d) where the diameter ϕ was 10 mm. Note that in each simulation, the air supply rate was 25.2 $m^3$/h, and the air supply temperature was 20° C.

Figure 21:
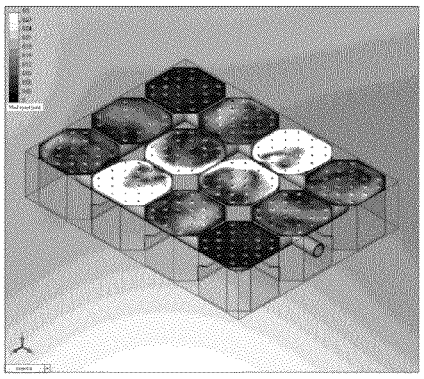
FIGS. 21(*a*), 21(*b*), 21(*c*), and 21(*d*) are simulation results showing distributions of wind speed in a hollow section, respectively, when a diameter ϕ of each circulation hole is 4 mm, when the diameter ϕ of each circulation hole is 6 mm, when the diameter ϕ of each circulation hole is 8 mm, and when the diameter ϕ of each circulation hole is 10 mm, in Example 2.
Figure 21:
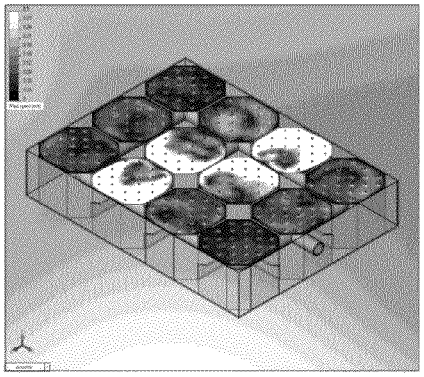
Figure 21:
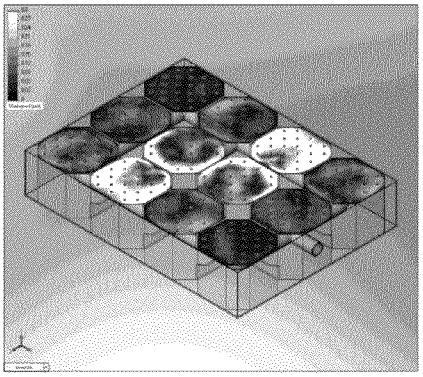
Figure 21:
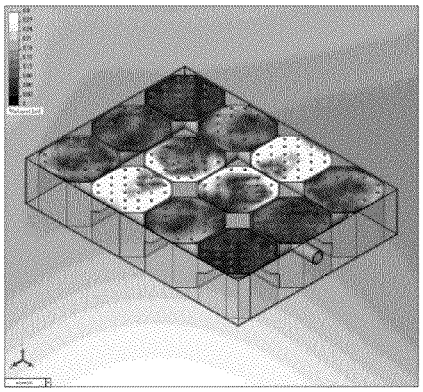

FIGS. 21(*a*), 21(*b*), 21(*c*), and 21(*d*) show distributions of wind speed in hollow sections 21 which were analyzed by the simulations when the diameter ϕ was 4 mm, when the diameter ϕ was 6 mm, when the diameter ϕ was 8 mm, and when the diameter ϕ was 10 mm.

As shown in FIG. 21, the difference in the size of the circulation hole 26 made little difference in the distribution of wind speed in the hollow sections 21. That is, the size of the circulation hole 26 is thought to little affect blowing speeds.

Therefore, in consideration of, e.g., energy loss due to air resistance at the time of blowing and ease of circulation of snowmelt water rather than uniformity in blowing speed, it is thought to be better to make the size of the circulation hole 26 as large as possible within the allowable range of strength design.

Example 3

Figure 22:
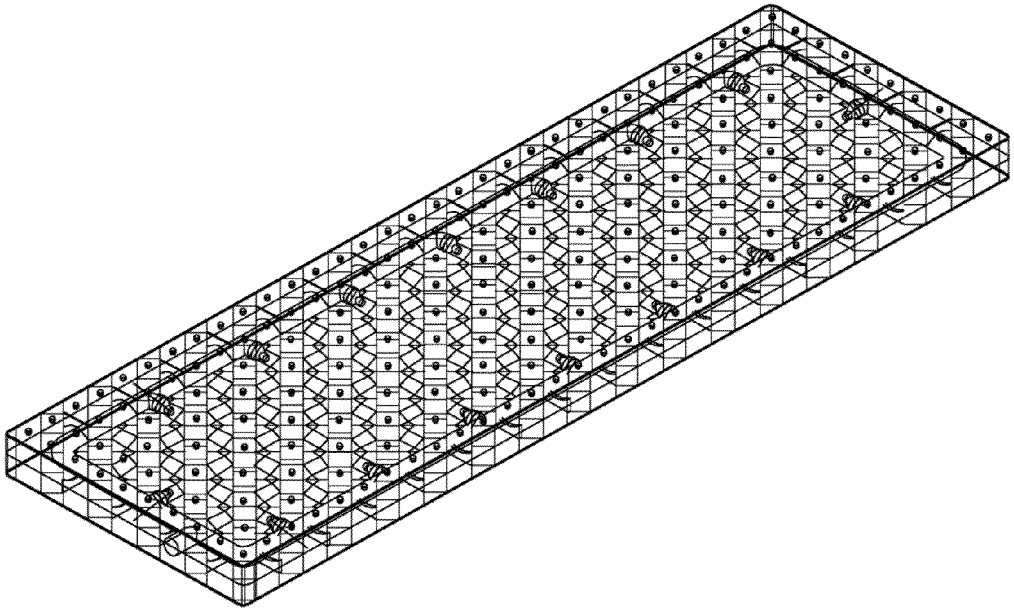
FIG. 22 is a perspective view showing an analysis model used in a simulation in Example 3.

In Example 3, a vent pipe 4 was discussed. An analysis model in this Example 3 is shown in FIG. 22. A hollow roadbed body 2 according to this Example 3 is composed of box-like roadbed bodies 22 arranged in 16 rows and 5 columns, and 4 circulation holes 26 having a diameter $\phi$ of 20 mm are formed in a top plate 23 of each box-like roadbed body 22. Note that the size of each box-like roadbed body 22 is the same as those in Examples 1 and 2.

Figure 23:
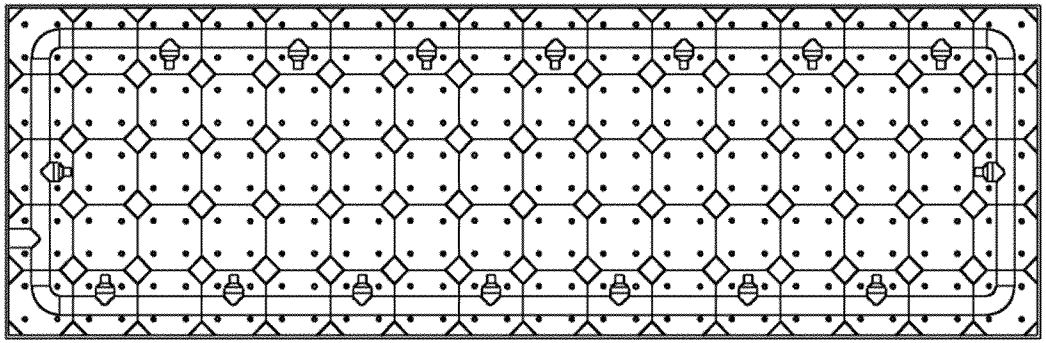
FIG. 23 is a plan view showing the analysis model used in the simulation in this Example 3.

As shown in FIG. 23, the vent pipe according to this Example 3 is formed in the shape of a substantially rectangular loop so as to extend through hollow sections 21 of the box-like roadbed bodies 22 arranged on the periphery. Blow-out sections 42 are arranged inside every other box-like roadbed body 22 along parallel long sides of the vent pipe 4 in a staggered manner. Distal ends of the blow-out sections 42 open toward the inside of the loop. In a first simulation, the diameter of an opening at the distal end of the blow-out section 42 was 25 mm.

The simulation was performed with a leg length of 75 mm of the hollow roadbed body, an air supply rate of 108 $m^3/h$, and an air supply temperature of 20° C. A result of the simulation is shown in FIG. 24.

Figure 24:
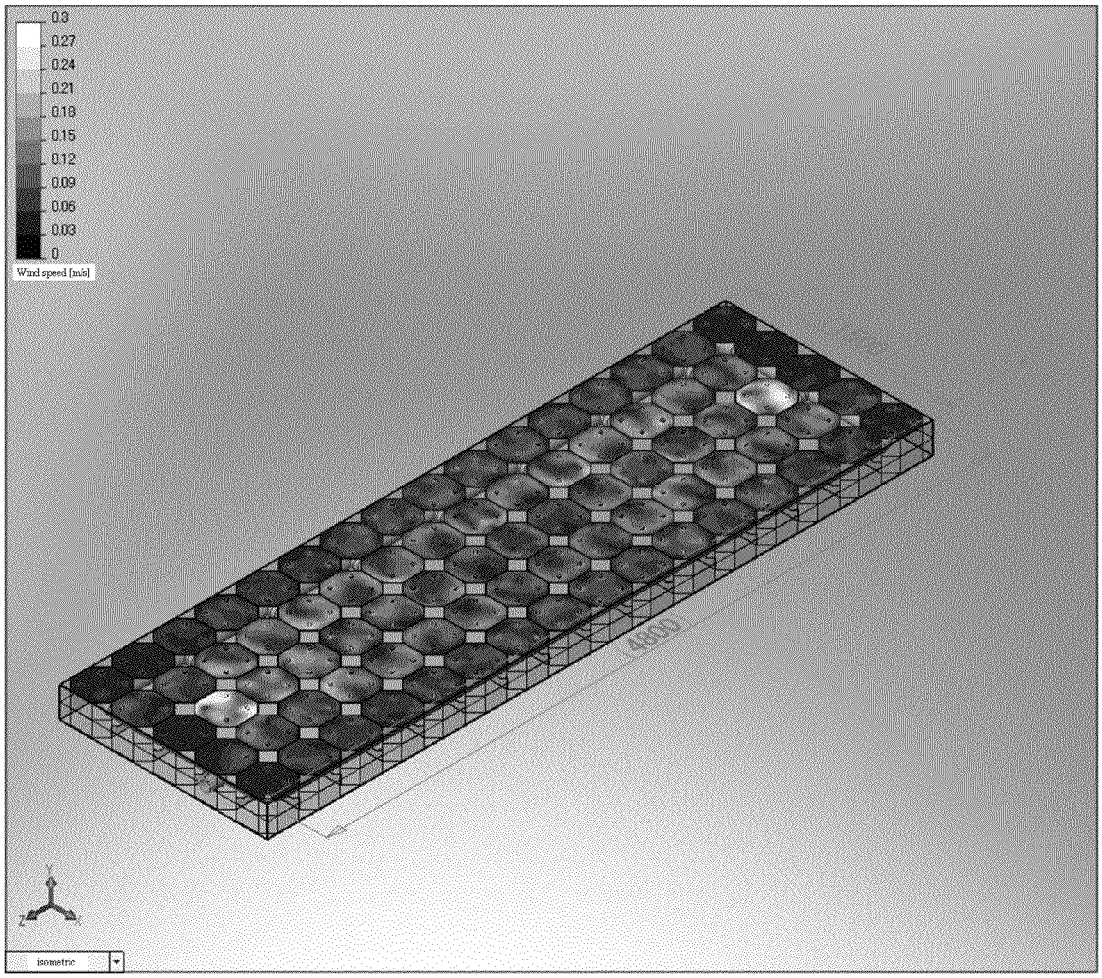
FIG. 24 is a simulation result showing a distribution of wind speed in a hollow section when the height of a hollow roadbed body is 225 mm, in this Example 3.

As shown in FIG. 24, it can be seen that wind speeds in the box-like roadbed bodies 22 in the first and 16-th rows which correspond to short sides of the vent pipe 4 are low while a wind speed is substantially uniform in the other box-like roadbed bodies 22. It is thus apparent that a wind speed can be made substantially uniform in the box-like roadbed bodies 22 by forming the vent pipe 4 in the shape of a loop, providing the blow-out sections 42 that open toward the inside of the loop at the vent pipe 4, and arranging the blow-out sections 42 at opposing positions in a staggered manner, under certain conditions.

Note that the reason for the lower wind speeds in the box-like roadbed bodies 22 in the first and 16-th rows is thought to be that the blow-out section 42 at an opposing position is away and that air from the opposing blow-out section 42 does not reach the box-like roadbed bodies 22.

Figure 25:
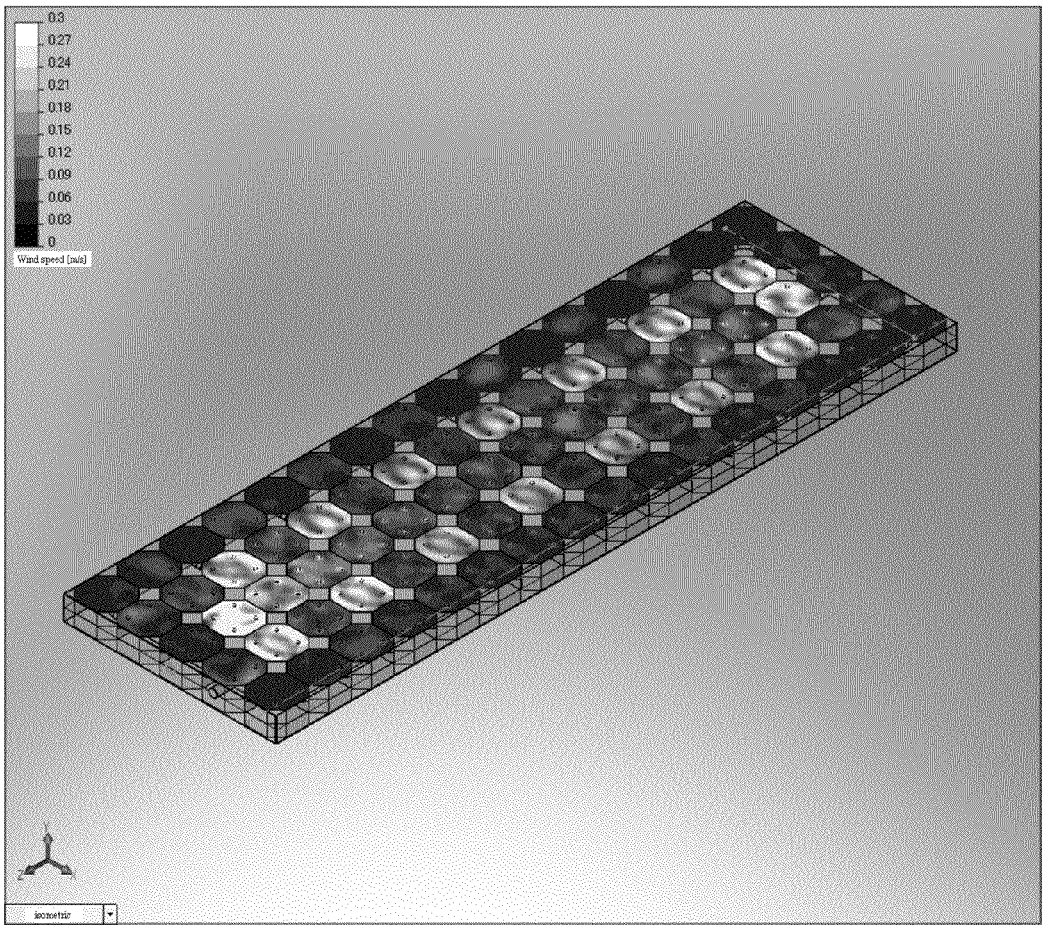
FIG. 25 is a simulation result showing a distribution of wind speed in the hollow section when the height of the hollow roadbed body is 175 mm in this Example 3.

A next simulation was performed with a different leg length of 25 mm of the hollow roadbed body. As a result, as shown in FIG. 25, wind speeds in the hollow sections 21 of the box-like roadbed bodies 22 arranged on the periphery were low on the whole. Inside the loop, a wind speed was high in the vicinity of each blow-out section 42 while a wind speed decreased with an increase in the distance from the blow-out section 42 in a blowing direction.

The reason for the non-uniformity in wind speed in the hollow sections 21 is thought to be that the reduction in the leg length of the hollow roadbed body 2 narrowed each hollow section 21 to block circulation of air and that enough air could not reach a part at an opposing position of the vent pipe 4.

For this reason, simulations were performed with various improvements made to the vent pipe 4 such that a wind speed is uniform in the hollow sections 21 even when the leg length of the hollow roadbed body 2 is 25 mm.

[Improvement 1]

Since the vent pipe 4 is laid in the box-like roadbed bodies 22 arranged on the periphery, the exhaust holes 43 having a diameter of 10 mm were formed in a lower surface of the vent pipe for each box-like roadbed body 22. A result of a simulation is shown in FIG. 26.

Figure 26:
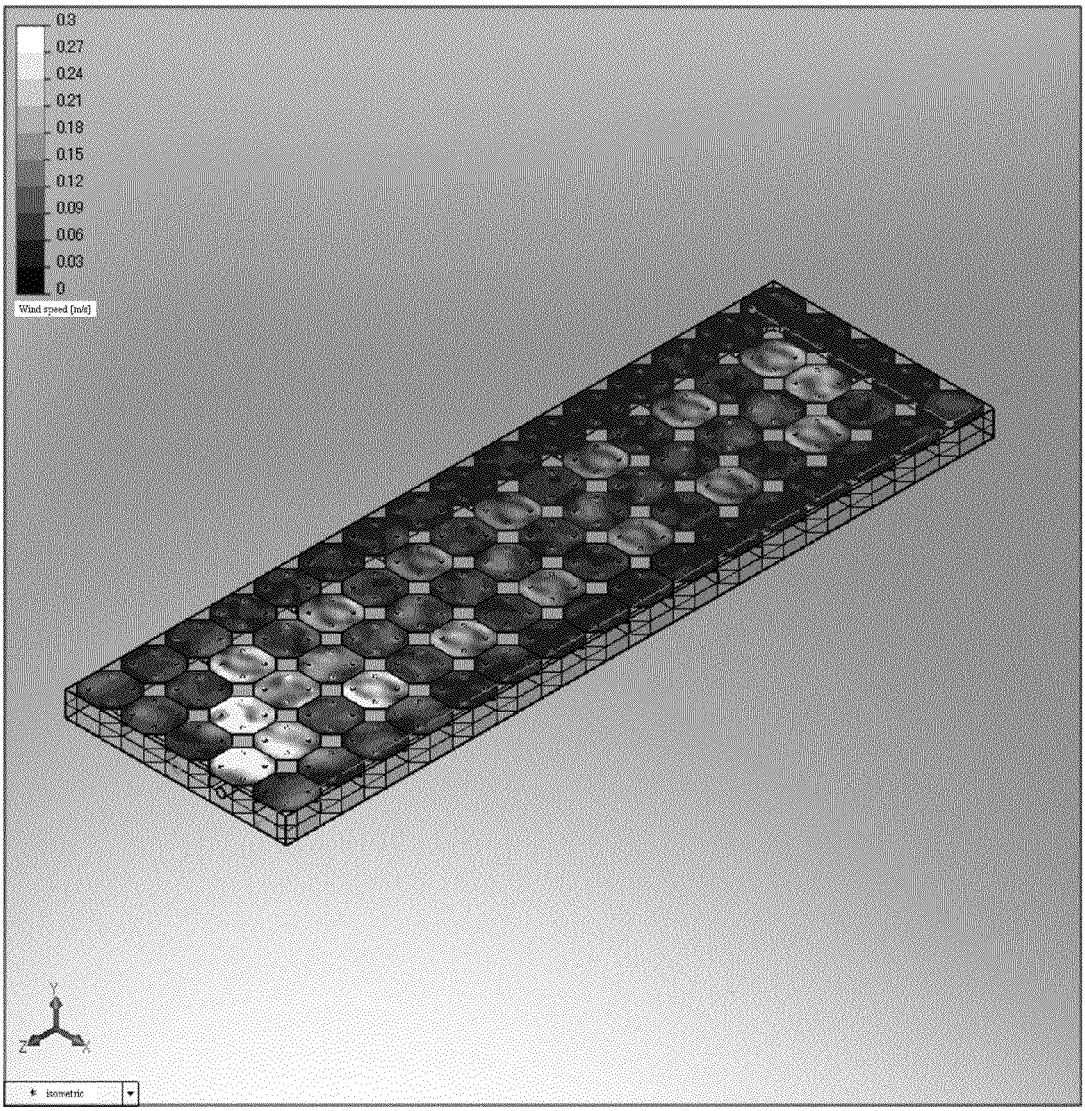
FIG. 26 is a simulation result showing a distribution of wind speed in the hollow section when the height of the hollow roadbed body is 175 mm, and Improvement 1 is made to a vent pipe, in this Example 3.

A comparison of FIG. 26 with FIG. 25 shows that wind speeds in the box-like roadbed bodies 22 arranged on the periphery are higher on the whole. A comparison of FIG. 26 with FIG. 24 shows that the wind speeds in the first and 16-th rows are slightly higher. This condition, however, could not make the overall wind speed in the hollow sections 21 substantially uniform.

[Improvement 2]

The exhaust holes 43 were formed not in the lower surface but in a loop outer peripheral surface of the vent pipe 4. In order to increase a blowing speed at the blow-out section 42, the diameter of an opening was changed to 20 mm.

Figure 27:
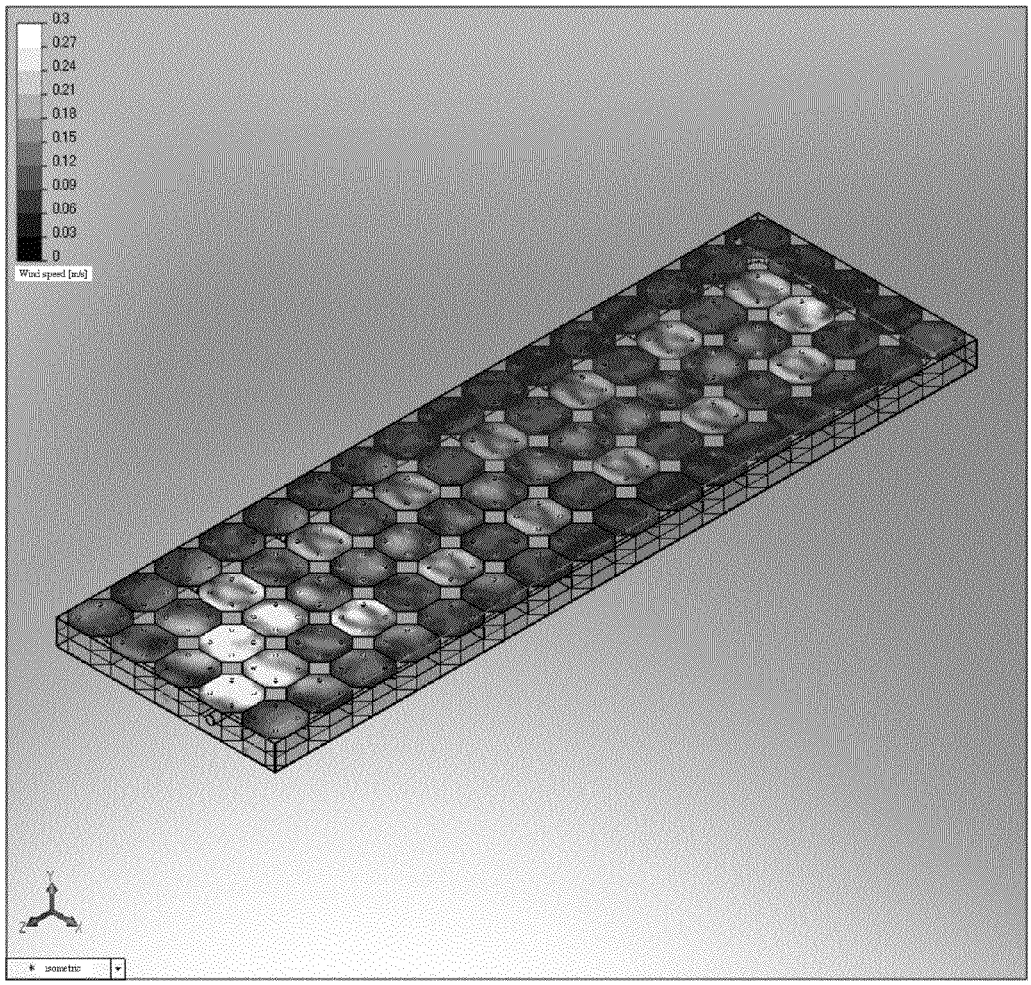
FIG. 27 is a simulation result showing a distribution of wind speed in the hollow section when the height of the hollow roadbed body is 175 mm, and Improvement 2 is made to the vent pipe, in this Example 3.

As shown in FIG. 27, this Improvement 2 made the overall wind speed uniform. It can thus be said to be more effective to provide the exhaust holes 43 in the loop outer side surface. Note that the exhaust holes 43 may be shifted upward or downward unless the exhaust holes 43 are located at the bottom.

Note that it can be seen that an area with a high wind speed is present in the vicinity of the blow-out section 42 provided on the left side of an air supply pipe 41. This is thought to be because there is a difference in the distance to the blow-out sections 42 provided on the left and right sides of the air supply pipe 41, and more air is blown from the blow-out section 42 with lower pressure loss, i.e., a shorter distance to the air supply pipe 41.

[Improvement 3]

Figure 28:
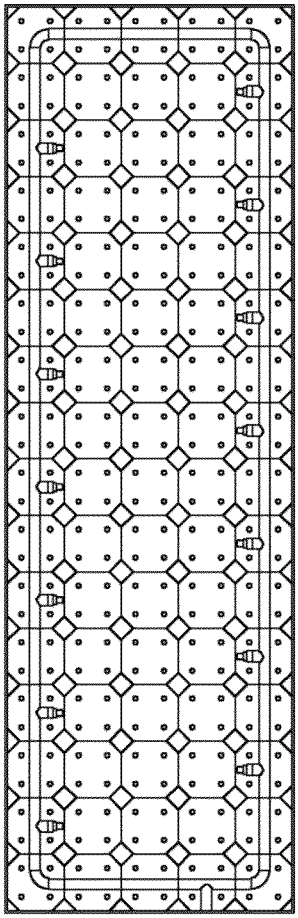
FIG. 28 is a plan view showing an analysis model used in a simulation when Improvement 3 is made, in this Example 3.

In Improvement 3, as shown in FIG. 28, the air supply pipe 41 was provided at a position as equidistant from two of the blow-out sections 42 which were provided on the left and right sides of the air supply pipe 41 as possible.

Figure 29:
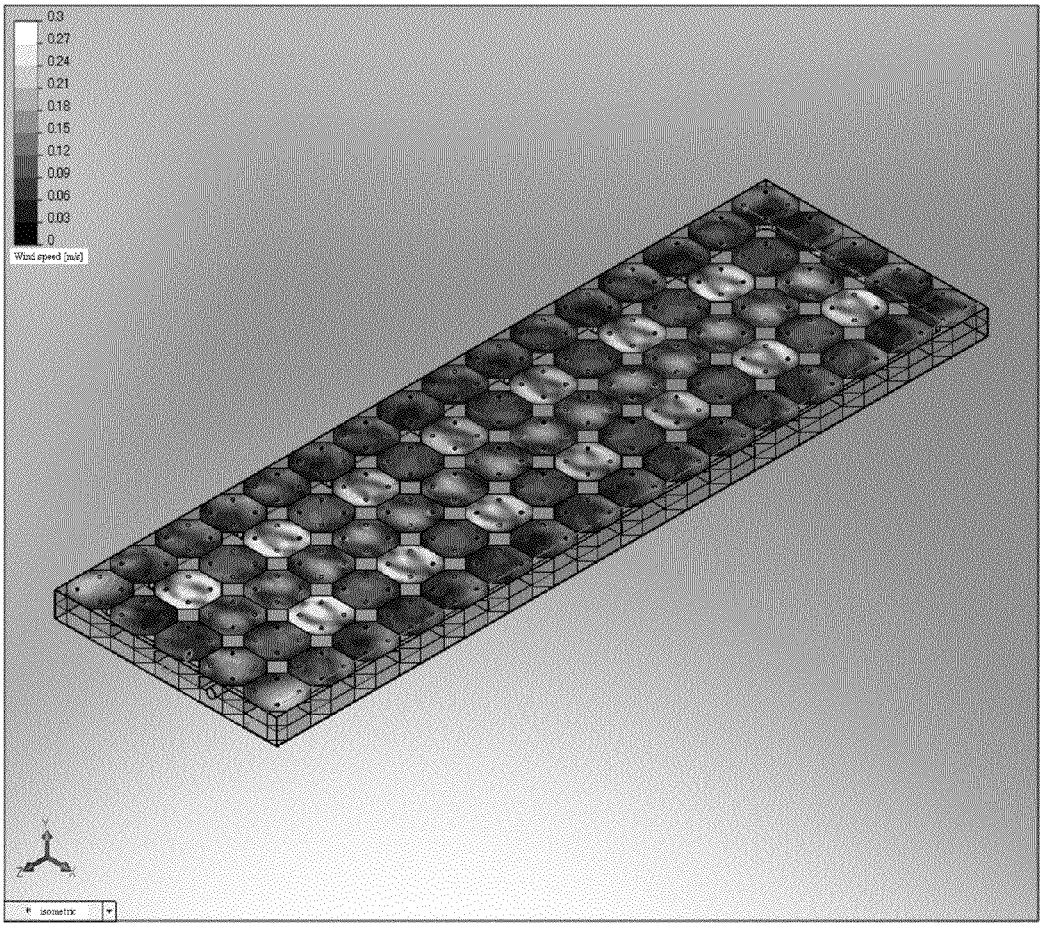
FIG. 29 is a simulation result showing a distribution of wind speed in the hollow section when the height of the hollow roadbed body is 175 mm, and Improvement 3 is made to the vent pipe, in this Example 3.

As a result, as shown in FIG. 29, it can be seen that there is no area with a high wind speed in the vicinity of the blow-out section 42 provided on the left side of the air supply pipe 41 and that a wind speed is substantially uniform across the entire area including the hollow sections 21 in the first and 16-th rows.

As has been described above, the following can be seen from the results of the experiments and simulations in Examples 1 to 3.

1. Under predetermined conditions, the vent pipe 4 is formed in the shape of a loop, the blow-out sections 42 that open toward the inside of the loop are provided at the vent pipe 4, and the blow-out sections 42 at opposing positions are arranged in a staggered manner. This configuration can make a wind speed in the hollow sections 21 substantially uniform.
2. The exhaust holes 43 are provided in the vent pipe 4, which allows replenishment of the hollow sections 21, in which the vent pipe 4 is laid, with air.
3. It is more effective to provide the exhaust holes 43 in a loop outer side surface.
4. The air supply pipe 41 is preferably coupled to a position substantially equidistant from two of the blow-out sections 42 which are provided on the left and right sides of the air supply pipe 41 in order to inhibit air from flowing disproportionately.

Note that the air-blowing-type road surface snow-melting system 1 according to the present invention is not limited to the above-described embodiment and can be appropriately changed.

Figure 30:
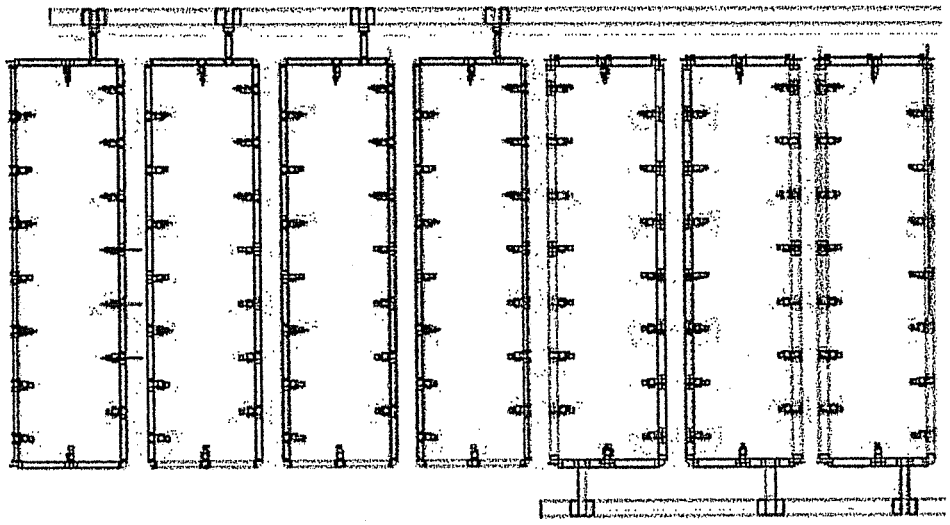
FIG. 30 is a plan view showing an example of the layout of laid vent pipes when a snow-melting area is large, according to another embodiment.

For example, although the vent pipe 4 according to the embodiment is laid so as to enclose a predetermined snow-melting area with one loop, if a snow-melting area is large or in other cases, the vent pipes 4 may be laid so as to enclose a snow-melting area with a plurality of loops, as shown in FIG. 30.

The loop shape of the vent pipe 4 is not limited to a substantially rectangular shape and may be a polygonal shape, such as a triangular shape, or a substantially circular shape to suit a snow-melting area.

The position, an angle at which air is blown, the hole size, and the like of each of the blow-out sections 42 and exhaust holes 43 provided at the vent pipe 4 are appropriately designed. The blow-out sections 42 and exhaust holes 43 may be provided substantially at right angles to the vent pipe 4 or provided so as to be slightly angled upward, downward, to the left, or to the right.

The hollow roadbed body 2 according to the embodiment is composed of a plurality of box-like roadbed bodies 22. The hollow roadbed body 2, however, may be configured such that the top plate 23 having an area substantially equal to a predetermined snow-melting area is supported by the supports 25, the number of which is enough to ensure strength required to constitute a road surface.

REFERENCE SIGNS LIST

1 air-blowing-type road surface snow-melting system
2 hollow roadbed body
3 air-permeable structure
4 vent pipe
5 frame
21 hollow section
22 box-like roadbed body
23 top plate
24 base plate
25 support
26 circulation hole
31 branched void network
41 air supply pipe
42 blow-out section
43 exhaust hole
44 drainage hole
51 cushioning material

The invention claimed is:

1. An air-blowing-type road surface snow-melting system comprising:

a hollow roadbed body which is buried beneath a road surface and includes a hollow section, an air-permeable structure provided on the hollow roadbed body and constituting the road surface, and a vent pipe which is laid inside the hollow section of the hollow roadbed body, wherein the vent pipe is laid in the shape of a continuous loop so as to completely enclose a predetermined snow-melting area and is provided with a plurality of blow-out sections which open toward the inside of the loop, and wherein a plurality of exhaust holes are opened in the vent pipe in a loop outer side surface along the vent pipe.

2. The air-blowing-type road surface snow-melting system according to claim 1, wherein the plurality of blow-out sections are arranged such that the blow-out sections at opposing positions are staggered in a looped frame.

3. The air-blowing-type road surface snow-melting system according to claim 1 or 2, wherein a position where an air supply pipe which supplies air to the looped vent pipe is coupled is spaced apart by a predetermined distance from the blow-out sections and is substantially equidistant from two of the blow-out sections which are arranged on the left and right sides of the air supply pipe.

4. The air-blowing-type road surface snow-melting system according to claim 1, wherein the exhaust holes are smaller than openings of the blow-out sections.

5. The air-blowing-type road surface snow-melting system according to claim 4, wherein a position where an air supply pipe which supplies air to the looped vent pipe is coupled is spaced apart by a predetermined distance from the blow-out sections and is substantially equidistant from two of the blow-out sections which are arranged on the left and right sides of the air supply pipe.

* * * * *